US005971697A

United States Patent [19]

Ballestrazzi et al.

[11] Patent Number: 5,971,697

[45] Date of Patent: Oct. 26, 1999

[54] DEVICE FOR OVERTURNING PACKAGED EDITORIAL PRODUCTS, FOR ASSOCIATION WITH A PACKAGING LINE

[75] Inventors: Aris Ballestrazzi; Lamberto Tassi, both of Savignano Sul Panaro, Italy

[73] Assignee: Sitma S.p.A., Spilamberto, Italy

[21] Appl. No.: 09/018,046

[22] Filed: Feb. 3, 1998

[30] Foreign Application Priority Data

Feb. 4, 1997 [IT] Italy ..... MI97A0208

[51] Int. Cl.[6] ..... B65G 57/081

[52] U.S. Cl. ..... 414/788.3; 414/730; 414/783; 414/791.3

[58] Field of Search ..... 414/763, 783, 414/788.3, 791.3, 730, 740, 741

[56] References Cited

U.S. PATENT DOCUMENTS 3,494,482 2/1970 Lense ..... 414/738 X
4,060,231 11/1977 Stobb et al. ..... 414/788.3 X
4,474,521 10/1984 Jaton ..... 414/788.3
4,784,558 11/1988 Toriyama ..... 414/788.3

FOREIGN PATENT DOCUMENTS 0 737 618 10/1996 European Pat. Off. .
25 35 123 3/1976 Germany .

*Primary Examiner*—Janice L. Krizek
*Attorney, Agent, or Firm*—Oblon, Spivak, McClelland, Maier & Neustadt, P.C.

[57] ABSTRACT

For association with a packaging line, a device for overturning packaged editorial products which grips the editorial products (12) advancing on a conveyor belt (13) and overturns them to superpose them on the next product in order to facilitate their final stacking within a collection element. Such a device is particularly advantageous when handling packaged editorial products the thickness of which varies along their length by virtue of consisting of at least one editorial product (12') combined within its wrapper with a second added product (12") of different dimensions.

7 Claims, 5 Drawing Sheets

DEVICE FOR OVERTURNING PACKAGED EDITORIAL PRODUCTS, FOR ASSOCIATION WITH A PACKAGING LINE

BACKGROUND OF THE INVENTION

1. Field of the Invention

This invention relates to a device for overturning packaged editorial products, for association with a packaging line. Special promotion campaigns for specific products can involve combining them with usual editorial products such as newspapers, magazines, books or the like during their packaging within a plastic or paper material which encloses them.

2. Discussion of the Background

In those industries which produce or distribute the said editorial products, these latter are combined at the client's request with an additional gift object such as a book, compact disc, floppy disc, perfume etc., in the form of a product of totally different size to be distributed in accordance with a predetermined program. The added product or object has to cover about one half of the base product and have a relevant thickness within the finished package. This fact results in difficulty in stacking or superposing such finished products one on another. If stacked incorrectly, such packages are subject to breakage or deterioration, either in terms of the product itself or in terms of its containing wrapper (paper or film).

Special devices have been designed for associating the added product with the editorial product before packaging. The operation, which up to this point is automatic, then becomes more difficult. This is because when discharged by a conveyor, the thus packaged products are not easy to collect into stacks as in the case of products of constant thickness.

A stack formed by a usual conveyor for discharging packaged products having a variable thickness along their length is not homogeneous and is difficult to maintain upright and composed during its handling.

Consequently, a combined package in which at least one editorial product and a second added product of very different dimensions have been wrapped together has to be removed manually from the conveyor. This requirement increases costs and does not allow operation at high speed.

In this respect, stacks have to be gradually formed inside the containers as the products are removed with the conveyor associated with the packaging line, while taking account of this variable thickness.

SUMMARY OF THE INVENTION

It is therefore an object of this invention to define and provide a device which solves this technical problem such as to automatically achieve simple and always correct product stacking. A further object is to provide a device which can be directly associated with a packaging line discharge conveyor while avoiding intermediate handling.

These and further objects are attained according to the invention by providing a device for overturning packaged editorial products which can be associated with a packaging line in which packaged products of variable thickness along their length are fed onto a conveyor, characterised by comprising, for at least one of said packaged products which advances, gripping elements which can be rotated so as to deposit said at least one gripped packaged product onto a packaged product located in succession upstream of said gripping elements by positioning it overturned relative thereto and complementarily superposed thereon.

By means of a device of the invention an ordered stack arrangement is automatically achieved composed of packaged products of variable thickness along their length as heretofore described. A stack formed in this manner can be further manipulated for insertion into a suitable container, by virtue of its extreme stability.

Moreover, such a device is rapidly adaptable to the packaged product for its manipulation.

BRIEF DESCRIPTION OF THE DRAWINGS

The operational and structural characteristics and advantages of a device of the invention will be more apparent from the description of one embodiment thereof given by way of non-limiting example with reference to the accompanying drawings, In which.

DETAILED DESCRIPTION OF THE PREFERRED EMBODIMENTS

The drawings show a device for overturning editorial products formed in accordance with the invention, arranged to manipulate packaged editorial products 12. A "packaged editorial product" means a composite packaged product the thickness of which varies along its length. In this respect, the package comprises at least one editorial product 12' of newspaper, magazine, book or similar type, combined during its packaging with a second different dimension product or added element 12", in the form of a gift such as a book, compact disc, floppy disc, perfume etc., of very different size and generally smaller.

This added product must cover about one half of the base product and have a relevant thickness within the finished package. The device is to be located on and associated with a packaging line, for example at the exit from a station for packaging editorial and other products in plastic and/or paper packaging material (not shown).

The device of the invention grips the packaged editorial products 12 which advance for example along a conveyor belt 13 and overturns them so as to superpose them on the next packaged product 12. In this manner a superposed arrangement of mutually overturned and complementarily positioned products is formed which facilitates their final stacking, for example within a collection element, not shown, such as a stacker generally associated with a packaging machine.

Figure 2:
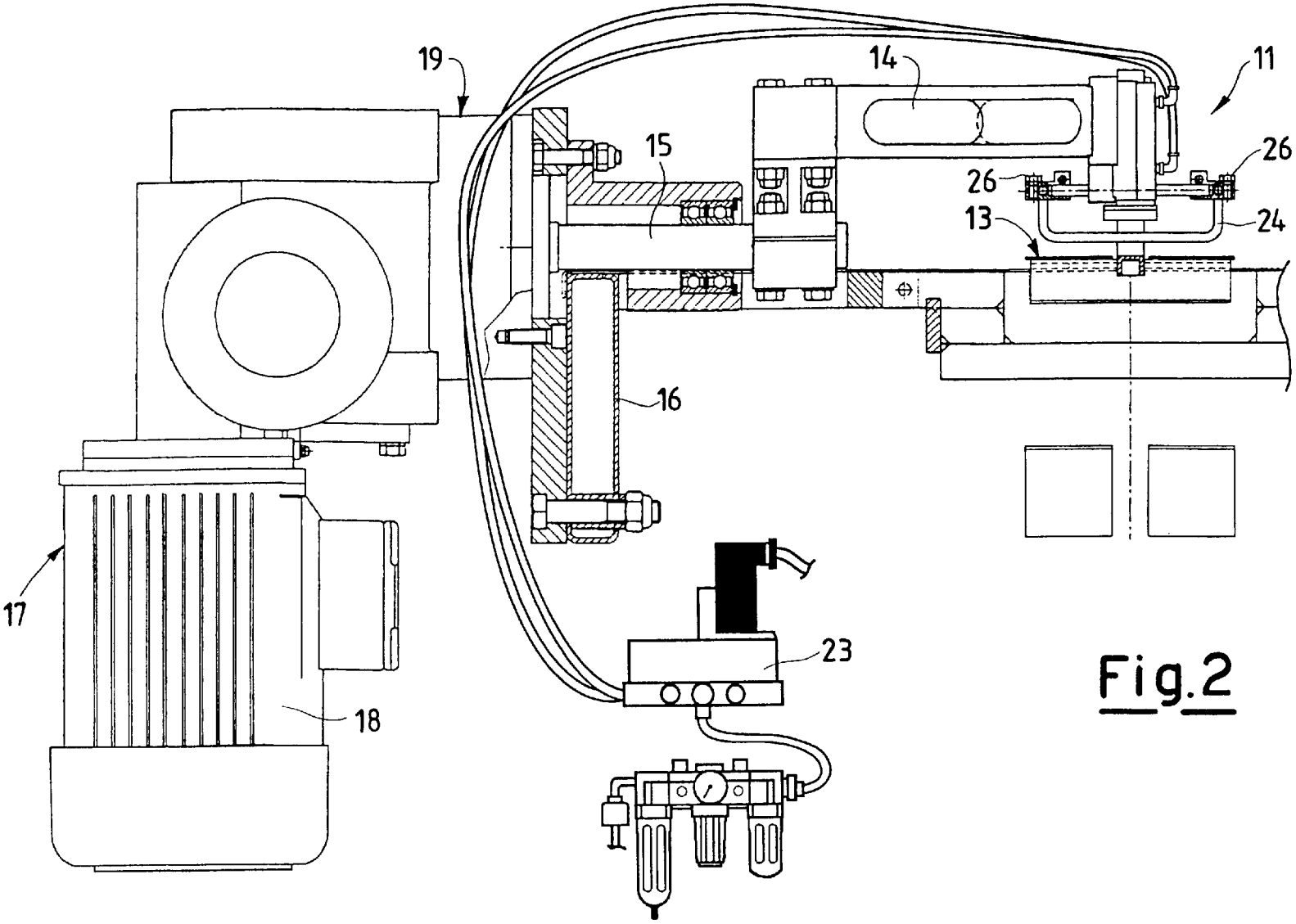
FIG. 2 is a cross-section through that shown in FIG. 1 in the gripping position for raising one of said products.
Figure 3:
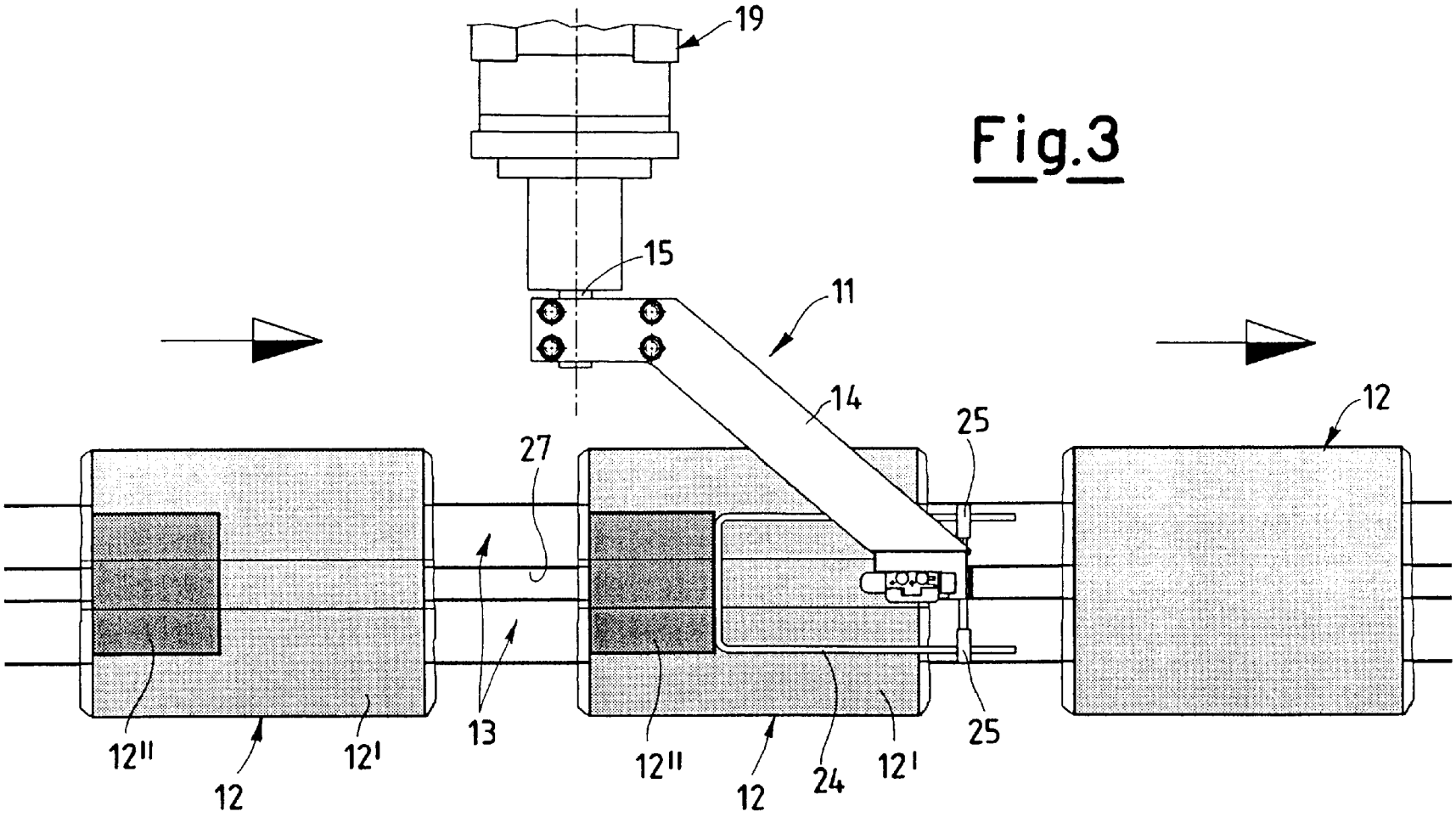
FIG. 3 is a simplified plan view of that shown in FIG. 1 in the full-line position.

Such a device 11 consists of a gripping element for said products 12, of the jaw type, arranged on a support arm 14. The arm 14 is positioned to the side of the conveyor belt 13 and is rotated about its pivotal axis or output shaft 15 positioned rigid with the machine frame or with its own base, shown schematically at 16 in FIG. 2.

The support arm 14 with relative gripping element is rotated by a mechanical oscillator mechanism indicated overall by 17 and consisting for example of an electric motor 18 with reduction gear combined with a mechanical inverter 19, so as to be movable to and fro between two predetermined positions.

Figure 1:
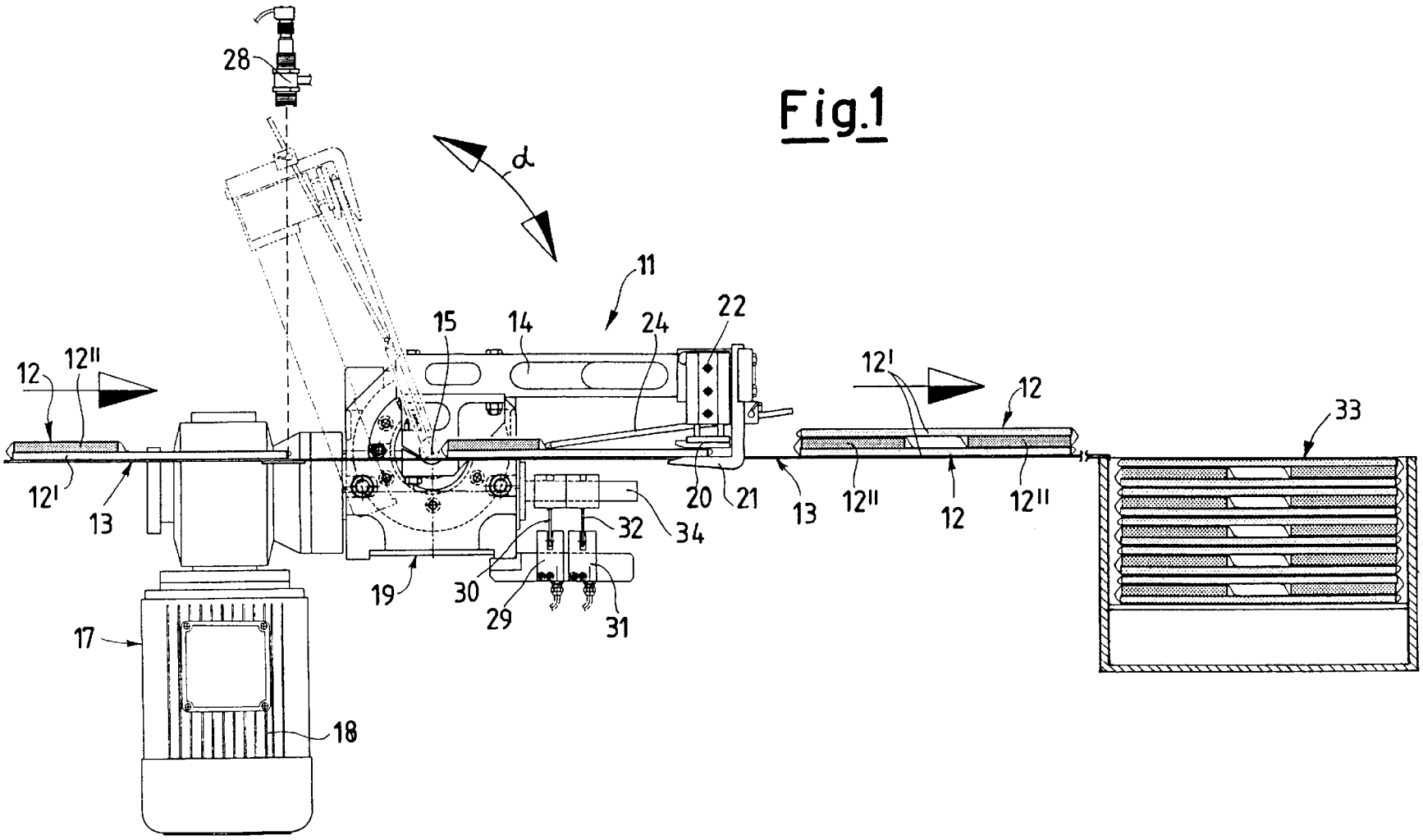
FIG. 1 is a schematic side elevation of a device of the invention positioned on a conveyor belt which advances spaced-apart packaged products into a position, shown in full lines, in which one of these products is gripped for raising into a position of maximum rotation, shown by dashed and dotted lines, for its unloading onto the next product, there also being shown a stack under formation on a final stacker.

The support arm 14 with its relative gripping element can be moved by this drive system between a first position in which one of the products 12 is gripped for raising, with the gripper aligned with the conveyor belt 13, and a raised position of maximum rotation, ready for unloading the gripped product 12 retained by the gripping element and inclined almost above the next product 12. In this manner a pair of combined products 12 is formed on the conveyor belt 13, and advances as far as a position in which it becomes stacked on a continuously forming stack 33 with other pairs of packaged products 12, as shown in FIG. 1. The stack 33 is advantageously of equal height on both sides (FIG. 1) notwithstanding the fact that the individual packaged product is of variable thickness along its length.

The gripping element, of jaw type, comprises a movable jaw 20 and a fixed jaw 21, which are connected to the free end of the support arm 14. The movable jaw 20 is positioned at the end of an actuator 22, such as a pneumatic cylinder connected to a control centre shown schematically at 23 in FIG. 2. The fixed jaw 21 has that end facing the movable jaw 20 curved in the opposite direction to the direction of advancement of the conveyor belt 13 and of the packaged products 12 arranged on it.

Rigid with the free end of the support arm 14 there is provided a stop element 24 for the packaged products 12 advancing along the conveyor belt 13. The stop element 24 is of adjustable position and in the illustrated example consists of a U-shaped round bar. The U-shaped round bar has its two sides inserted into a block 25 rigid with the support arm 14, the base of the U-shaped round bar acting as the actual stop by grazing the underlying conveyor belt and acting against the added element 12" of the packaged product 12. Adjustability is achieved by moving the sides of the round bar within the block 25 on the basis of the length of the added element and locking them in the selected position by end screws 26.

It should also be noted that in the example the conveyor belt consists of two parallel belts 13 spaced apart to form a continuous channel 27 within which at least the fixed jaw 21 of the gripping element can be inserted to receive the packaged products 12 advancing one after another.

FIG. 1 also shows the presence of a sensor 28, for example in the form of a photoelectric cell, positioned above the conveyor belt 13 before the device, with respect to the direction of advancement of the packaged products 12. The sensor 28 senses the front and initial part of each advancing packaged product and starts the rotation of the movable arm 14, i.e. it determines the activation of the overturning device of the invention.

Figure 6:
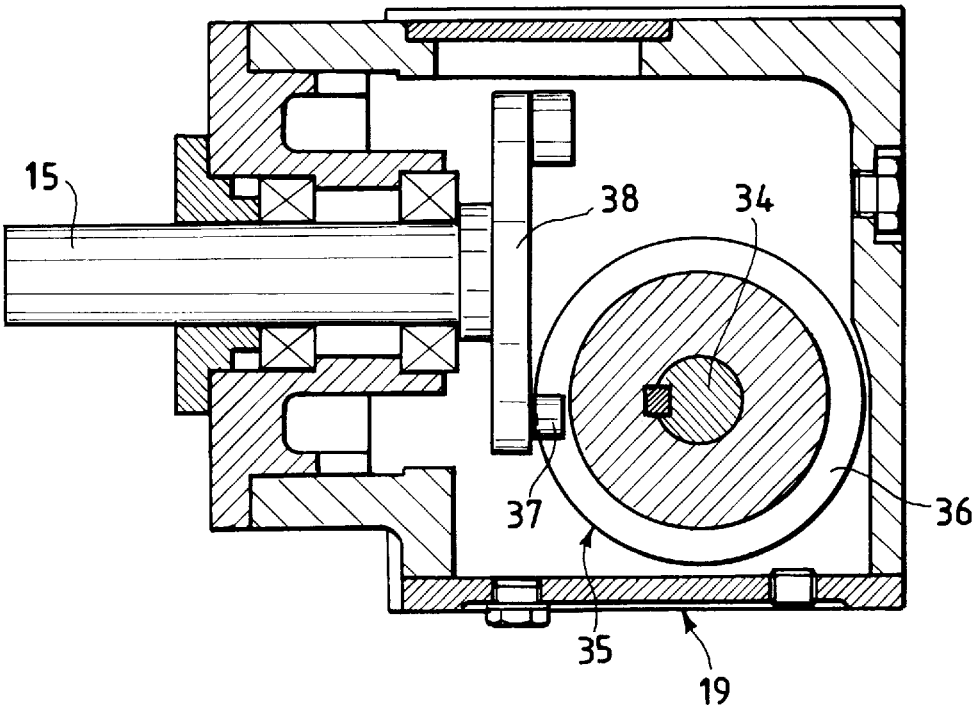
FIG. 6 is a first schematic section through a mechanical inverter located at the exit of the drive unit, in which the output shaft driving the device can be better seen.
Figure 7:
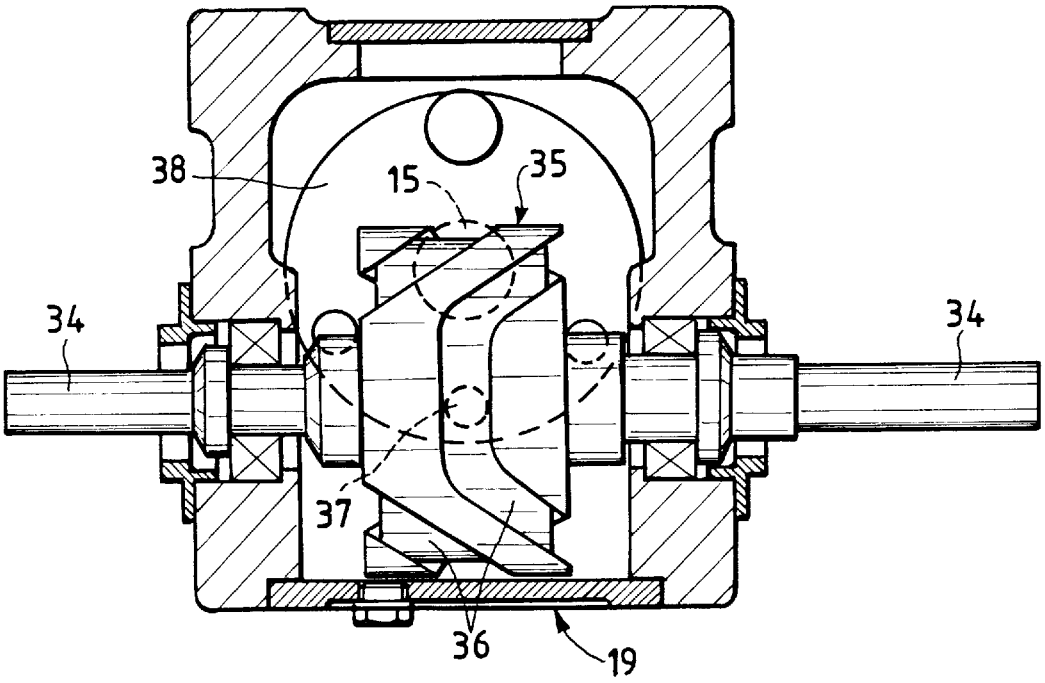
FIG. 7 is a second schematic section through the inverter of FIG. 6, in which the input shaft can be better seen.

In addition to the output shaft 15, the inverter 19 comprises an input shaft 34 which obtains its movement directly from the motor 18. As can be seen in FIGS. 6 and 7, on the input shaft 34 there is positioned a drum 35 with cam grooves 36 in which bearings or wheels 37 selectively engage. The bearings 37 are positioned idle on a flange plate 38 located rigid with the end of the output shaft 15, which has its axis perpendicular to that of said input shaft 34. The cam grooves 36 are of symmetrical sinusoidal pattern to determine the selective movement of the output shaft 15 and consequently the controlled rotation of the device support arm 14.

The mechanical oscillator mechanism can also consist of a rotary cylinder or a linear cylinder moving a lever which causes the arm with the gripping element to oscillate.

Figure 4:
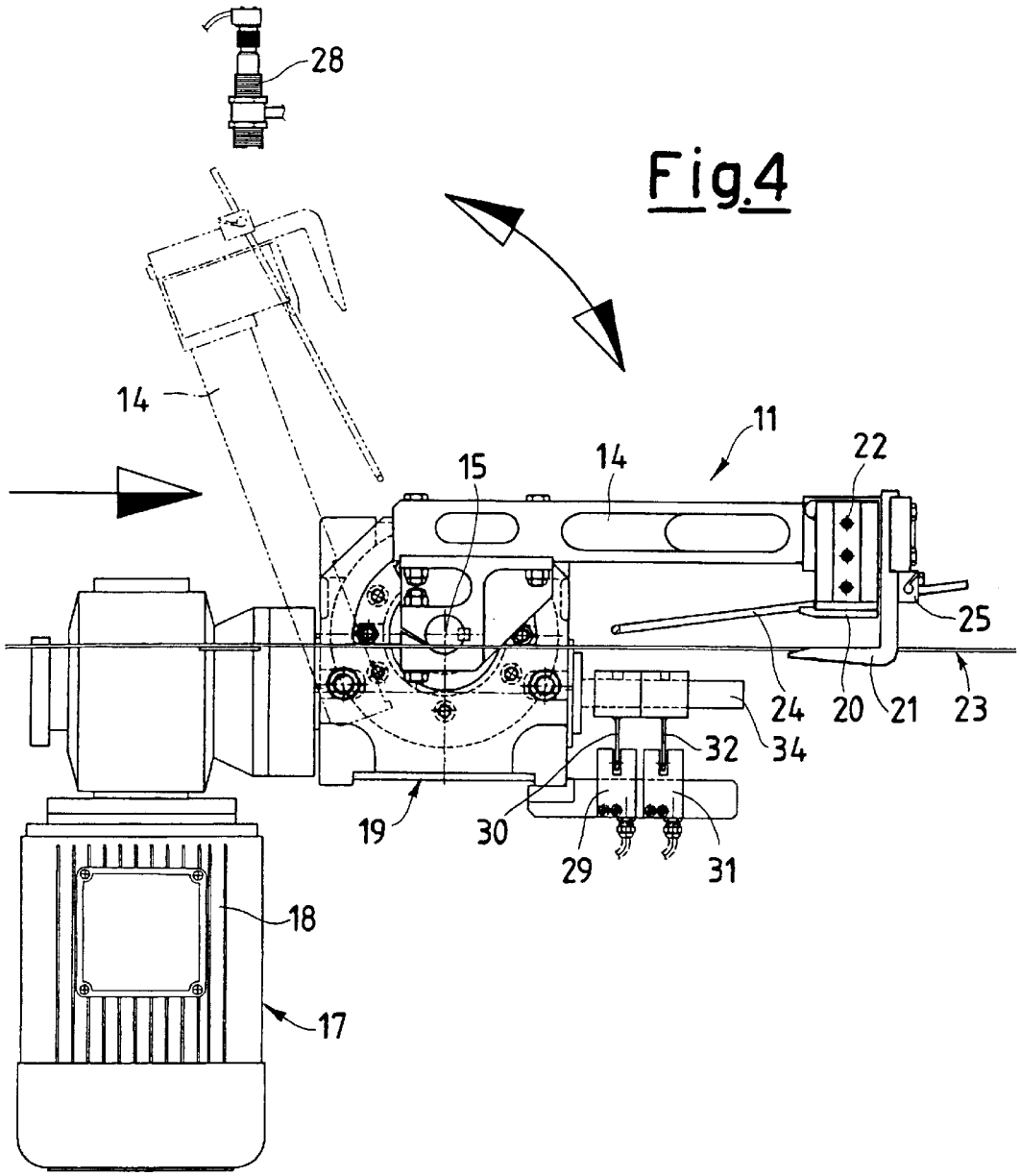
FIG. 4 is a side elevation similar to FIG. 1 with, in full lines, the gripping element shown open ready to receive a packaged product and, in dashed and dotted lines, the gripping element shown open in its position of maximum rotation after releasing the product.

In particular, in the type of operation described by way of example, but which can be modified without however leaving the scope of the invention, during start-up the device is located in a rotated raised position as shown by dashed and dotted lines in FIG. 4.

Figure 5:
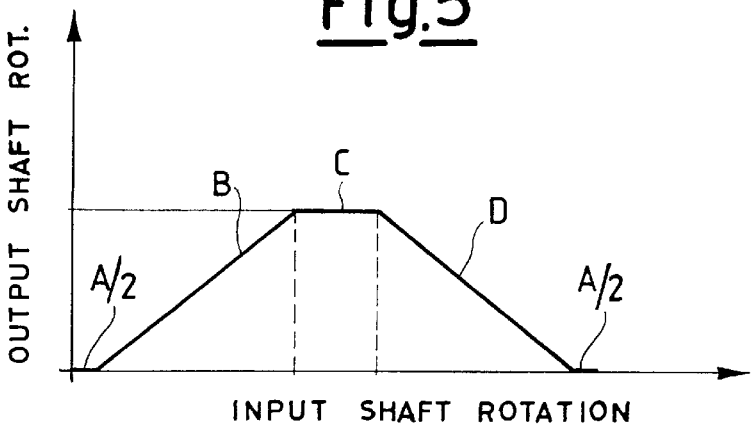
FIG. 5 is a diagram showing along the vertical axis the angle of rotation of the shaft carrying the gripping element, and along the horizontal axis the angle of rotation of the input drive shaft for its rotation through 360°.

When the sensor 28 senses a first packaged product 12, the motor 18 is started and the input shaft 34 of the inverter 19 begins to rotate. At least one of the bearings 37 begins to slide in the respective cam groove 36, but within a straight portion and hence without determining rotation of the output shaft 15. This operating stage is shown in FIG. 5 by a first portion A/2. As soon as the bearing 37 reaches the inclined portion of the cam groove 36, it begins to also rotate the flange plate 38 on which the bearing is rotatably positioned. The inverter output shaft 15 then also begins to rotate. This is all represented by the portion B of FIG. 5.

The rotation of the shaft 15 compels the support arm 14 to rotate downwards towards the conveyor belt 13 so as to reach a position ready to receive the advancing product with the gripping element in the open position. Rotation continues until the arm is brought into the position shown by full lines in FIG. 4, in which position a magnetic sensor 29 interacts with a counteracting cam portion 30 mounted on the input shaft 34 to cause the jaws 20 and 21 to close. In this respect, the movable jaw 20 is moved by the cylinder 22 to close against the underlying fixed jaw 21. In this manner the jaws 20 and 21 clamp the packaged product 12, once the stop element 24 has determined the exact clamping and gripping position on the basis of the size of the added element 12" (as shown in FIG. 1 by full lines).

During this stage in which the packaged product is received and clamped, the output shaft 15 stops because the bearing 37 slides in the respective cam groove 36 within a second straight portion and hence without rotating the output shaft 15. This operating stage is represented in FIG. 5 by the portion C.

The shaft 15 then begins to rotate in the reverse direction to return the arm 14, and the packaged product 12 rigidly clamped to it, into the position of maximum rotation. Rotation again takes place because the bearing 37 reaches a third inclined portion of the cam groove 36 to again rotate the flange plate 38 rigidly connected to the inverter output shaft 15. All this is represented by the portion D of FIG. 5.

This rotation continues until the angle of maximum rotation is attained, with the support arm 14 and gripped product 12 in the position shown by dashed and dotted lines in FIG. 1. A suitable angle of rotation a is considered to be more than 100°.

When the arm is in this maximum raised position with the packaged product between the jaws 20 and 21 of the gripping element, a second magnetic sensor 31 interacting with a respective counteracting cam portion 32 also mounted on the input shaft 34 stops the rotation of the motor. The output shaft 15 had already stopped within the portion A/2 as the bearing 37 had travelled along a further straight portion of the cam groove 36.

The sensor 28 senses the passage of the next packaged product 12, but does not vary the drive. This is because this next product has to receive on it the first product, which in the meantime has been rotated and is retained between the jaws 20 and 21 of the arm 14.

After a predetermined time the jaws 20 and 21 open and the first packaged product falls onto the next packaged product. Having accomplished this, the arm 14 and the jaws 20, 21 remain in this rotated raised rest position, shown by dashed and dotted lines in FIG. 4.

They remain in this position until the sensor 28 senses passage of the end of the subsequent packaged product 12. This sensing again starts the input shaft 34 as already described, and the various stages described for the first product are repeated.

The complete cycle is repeated for every two packaged products arriving spaced-apart in succession one after another, for all the products to be packed. For the odd-numbered products (1st, 3rd, 5th etc.) the motor rotates and the mechanical oscillator is operated. For the even-numbered products (2nd, 4th, 6th etc.) the motor and mechanical oscillator remain at rest, and only the packaged product conveyor advances. In this manner the two mutually overturned products lying complementarily one above the other can be superposed.

FIG. 5 shows the relationship between the rotation of the output shaft 15, shown along the vertical axis as an angle of rotation, and of the input drive shaft 34, shown along the horizontal axis as an angle of rotation per 360° revolution of the input shaft.

This graph hence shows the complete cycle of movement of the output shaft 15, i.e. when it operates, when it is at rest and when it operates in the reverse direction while the input shaft 34 rotates continuously, this however happening in the cycle only for the odd numbered products.

It is therefore apparent that the invention represents a simple and comfortable solution to the problem of positioning packaged products which are of variable thickness along their length because they consist of at least one editorial product combined within its wrapper with a second product of different size, as already stated.

The proposed technical solution makes it possible to position products in a composite superposed arrangement. Specifically, the products are positioned mutually overturned and arranged complementarily, so greatly facilitating their final stacking, with space saving and in particularly with greater stability of the resultant stack.

The Italian priority application No. MI97A 000208 is herein incorporated by reference.

We claim:

1. A device for overturning packaged editorial products associated with a packaging line in which packaged products of variable thickness along their length are fed onto a conveyor, comprising:

gripping elements for gripping at least one of said packaged products, said gripping elements being rotated so as to deposit said gripped packaged product onto another packaged product located in succession upstream of said gripped packaged product by positioning the gripped packaged product in an overturned position and complementarily superposed thereon;

said gripping elements being rigidly attached to an arm and carried thereby, said arm being located to the side of said conveyor and rotated by a mechanical oscillator;

said mechanical oscillator including a mechanical inverter connected to a motor which is activated by a sensor which senses the passage of each packaged product;

said mechanical inverter including an input shaft connected to said motor and an output shaft connected to said arm, there being interposed between said input shaft and said output shaft a coupling arrangement including at least one cam groove of sinusoidal form on one shaft and at least one bearing on the other shaft.

2. A device for overturning packaged editorial products associated with a packaging line in which packaged products of variable thickness along their length are fed onto a conveyor, comprising:

gripping elements for gripping at least one of said packaged products, said gripping elements being mounted on an arm and rotated so as to deposit said gripped packaged product onto another packaged product located in succession upstream of said gripped packaged product by positioning the gripped packaged product in an overturned position and complementarily superposed thereon;

said gripping elements being rigidly attached to an arm and carried thereby, said arm being located to the side of said conveyor and rotated by a mechanical oscillator;

a stop element for stopping said packaged products advancing on said conveyor, said stop element being mounted on said arm at a position so as to cooperate with said gripping elements;

said stop element including a U-shaped round bar with two sides inserted into a block which is rigidly mounted on said arm, a base of said U-shaped round bar acting as a stop by contacting said packaged product, said two sides being movable within said block and locked in position by locking elements.

3. A device as claimed in claim 2, characterised in that the position of said stop element can be adjusted on the basis of said packaged products.

4. A device for overturning packaged editorial products associated with a packaging line in which packaged products of variable thickness along their length are fed onto a conveyor, comprising:

gripping elements for gripping at least one of said packaged products, said gripping elements being rotated so as to deposit said gripped packaged product onto another packaged product located in succession upstream of said gripped packaged product by positioning the gripped packaged product in an overturned position and complementarily superposed thereon;

an arm on which said gripping elements are mounted;

mechanical oscillator including a counteracting cam portion for rotatably moving said arm;

a magnetic sensor for sensing the position of said counteracting cam portion to produce a gripping signal for causing said gripping element to close.

5. A device as claimed in claim 4, further comprising:

a second magnetic sensor which senses a position of said counteracting cam portion for producing a stop signal; and a drive motor for driving said mechanical oscillator, said drive motor receiving said stop signal to stop said drive motor.

6. A device as claimed in claim 4, characterised in that said gripping elements are rotatable between a position aligned with said conveyor in which they grip one of said packaged products to raise it, and a raised position of maximum rotation ready for discharging one of said products which is gripped and retained inclined nearly above the next packaged product.

7. A device as claimed in claim 4, characterised in that said conveyor consists of at least one pair of belts positioned parallel to each other and spaced apart to form a continuous channel into which said gripping elements are inserted.

* * * * *